US009461423B2

(12) United States Patent
Tsai et al.

(10) Patent No.: US 9,461,423 B2
(45) Date of Patent: Oct. 4, 2016

(54) ELECTRICAL CONNECTOR

(71) Applicant: FOXCONN INTERCONNECT TECHNOLOGY LIMITED, Grand Cayman (KY)

(72) Inventors: Kuei-Chung Tsai, New Taipei (TW); Jian-JIa Qi, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/566,605

(22) Filed: Dec. 10, 2014

(65) Prior Publication Data

US 2015/0162713 A1 Jun. 11, 2015

(30) Foreign Application Priority Data

Dec. 10, 2013 (CN) ..... 2013 1 0663099

(51) Int. Cl.

| | |
|---|---|
| ***H01R 24/00*** | (2011.01) |
| ***H01R 24/60*** | (2011.01) |
| ***H01R 12/72*** | (2011.01) |
| *H01R 13/405* | (2006.01) |
| *H01R 13/6471* | (2011.01) |

(52) U.S. Cl.

CPC ..... *H01R 24/60* (2013.01); *H01R 12/724* (2013.01); *H01R 13/405* (2013.01); *H01R 13/6471* (2013.01)

(58) Field of Classification Search

CPC H01R 24/60; H01R 24/724; H01R 13/6471; H01R 13/405; H01R 13/642; H01R 12/73; H01R 12/721; H01R 23/02

USPC ..... 439/676, 260, 325, 629, 630, 637, 660, 439/679

See application file for complete search history.

(56) References Cited

U.S. PATENT DOCUMENTS

| | | | | |
|---|---|---|---|---|
| 6,439,931 | B1 * | 8/2002 | Niitsu | H01R 23/6873 439/660 |
| 6,811,433 | B2 * | 11/2004 | Jou | H01R 13/64 439/541.5 |
| 6,916,209 | B1 | 7/2005 | Casher | |
| 6,926,565 | B2 * | 8/2005 | Fogg | H01R 12/721 439/862 |

(Continued)

FOREIGN PATENT DOCUMENTS

| | | | |
|---|---|---|---|
| CN | 102244325 | A | 11/2011 |
| CN | 202872032 | U | 4/2013 |
| JP | 2007115707 | A | 5/2007 |

*Primary Examiner* — Tulsidas C Patel
*Assistant Examiner* — Travis Chambers
(74) *Attorney, Agent, or Firm* — Ming Chieh Chang; Wei Te Chung

(57) ABSTRACT

An electrical connector includes an insulative housing (10), a number of upper terminals (20) and a number of lower terminals (30) received in the insulative housing. The upper terminals comprise a pair of signal terminals (21) and a ground terminal (22) on one side of the pair of the pair of signal terminals; and an insulative body insert molded with the upper terminals to constitute a terminal module. The upper terminal has a fixed portion (201) and an elastic arm (301). Both the fixed portions of the signal terminal and the ground terminal have a same first width (201*a*). Both the elastic arms of the signal terminal and the ground terminal have a same second width (202*a*). The second width is wider than the first width. Every two adjacent fixed portions of the upper terminals are equidistant, and every two adjacent elastic arms of the upper terminals are equidistant.

9 Claims, 7 Drawing Sheets

(56) References Cited

U.S. PATENT DOCUMENTS 7,198,519 B2 4/2007 Regnier et al.
7,837,492 B2 * 11/2010 Zhu ..... H01R 12/57 439/329
8,272,900 B2 * 9/2012 Hunkins ..... H01R 12/712 439/108
2012/0142200 A1 * 6/2012 Ito ..... H01R 13/6471 439/65
2013/0196550 A1 * 8/2013 Casher ..... H01R 12/724 439/660
2013/0288540 A1 * 10/2013 Cheng ..... H01R 24/76 439/688
2015/0017822 A1 * 1/2015 Yang ..... H01R 13/6474 439/95

* cited by examiner

ELECTRICAL CONNECTOR

BACKGROUND OF THE INVENTION

1. Field of the Invention

The present invention relates to an electrical connector and especially relates to differentially coupled terminals of the electrical connector.

2. Description of Related Art

U.S. Publication No. 2013/0196550 discloses a differentially coupled electrical connector including an insulative housing, a number of upper terminals, and a number of lower terminals. The upper terminals are insert molded in a terminal block. The terminal block supports the upper terminals and is mounted to the housing. The upper terminals include a pair of signal terminals and a respective ground terminal on one of two sides of the pair of signal terminals. The upper terminal includes a tail, a contact, and a body. The body of the terminal includes a block portion and a free portion. By using preferential differential coupling, it is possible to decrease the insertion loss to about 0.1 dB dip and to move the frequency of this dip loss out to frequencies greater than 11 GHz, compared to an exemplary connector with a 0.5 dB dip in insertion loss at about 8 GHz.

In the above prior art design, terminals having a different structure are required to achieve a better performance at high frequencies.

An electrical connector having a good performance at high frequency is desired.

SUMMARY OF THE INVENTION

Accordingly, an object of the present invention is to provide an electrical connector requiring a number of terminals with specific structure while achieving a good performance of high frequency.

In order to achieve the object set forth, the invention provides an electrical connector comprising: an insulative housing defining a front mating face, an upper wall, a lower wall, and a receiving space between the upper wall and the lower wall, the upper wall defining a plurality of first terminal slots, the lower wall defining a plurality of second terminal slots; a plurality of upper terminals and a plurality of lower terminals received in the insulative housing, the upper terminals comprising a pair of signal terminals and a ground terminal on one side of the pair of the pair of signal terminals; and an insulative body insert molded with the upper terminals to constitute a terminal module, the upper terminal having a fixed portion insert molded in the insulative body and an elastic arm extending beyond the insulative body and received in the first terminal slot; wherein both the fixed portions of the signal terminal and the ground terminal have a same first width, both the elastic arms of the signal terminal and the ground terminal have a same second width, the second width is wider than the first width, every two adjacent fixed portions of the upper terminals are equidistant, and every two adjacent elastic arms of the upper terminals are equidistant.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
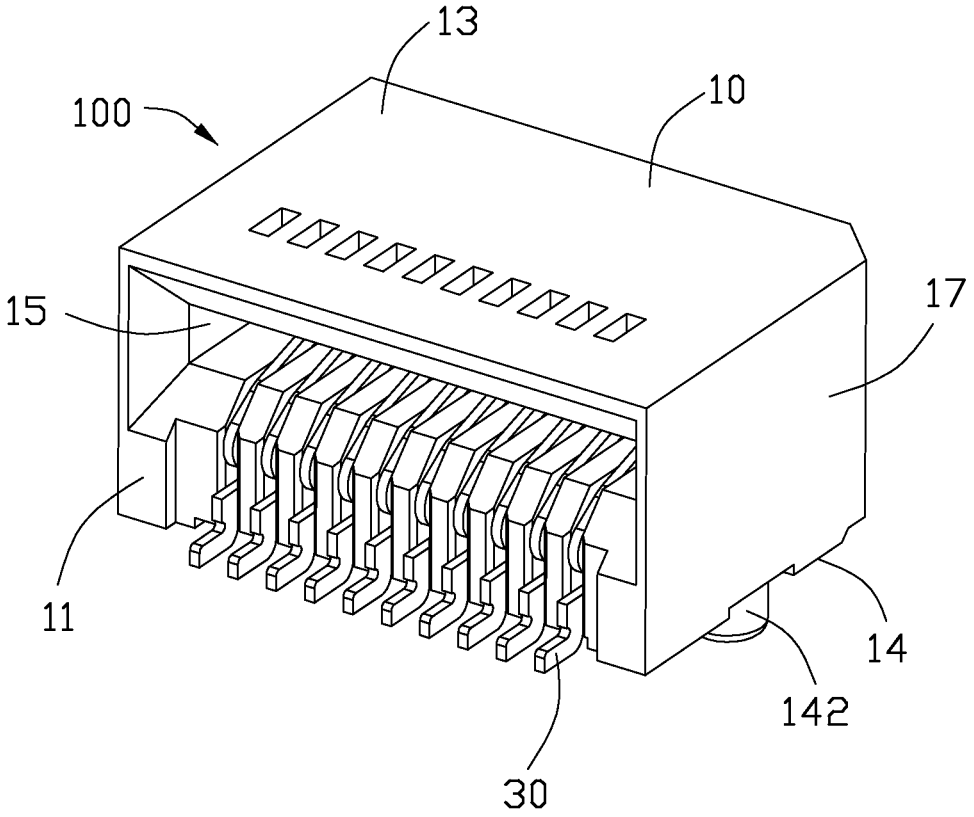
FIG. 1 is a perspective view of an electrical connector according to the present invention.
Figure 2:
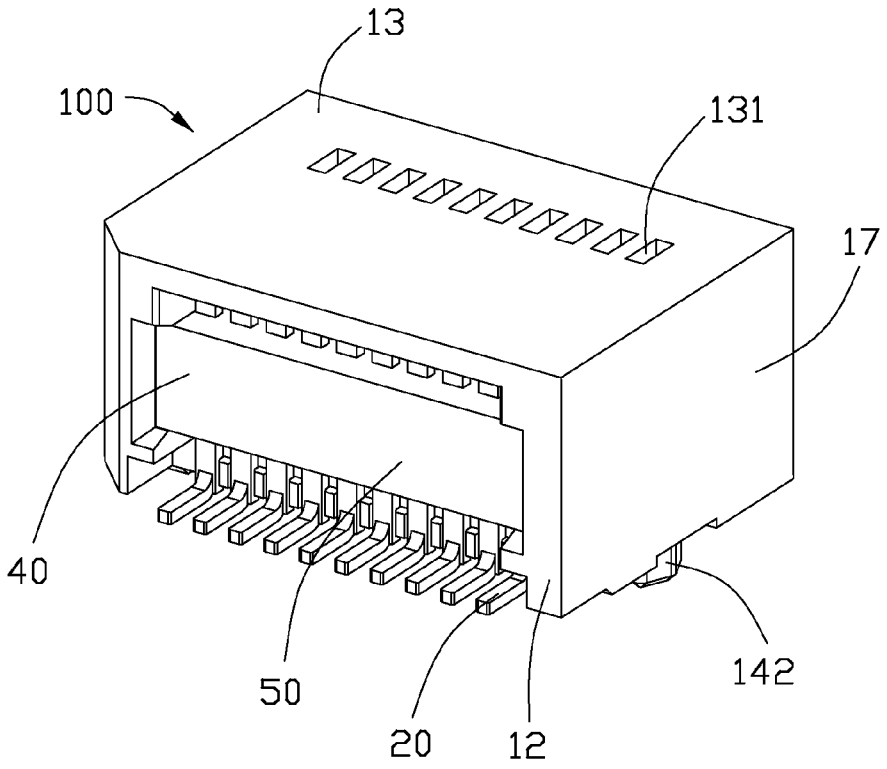
FIG. 2 is another perspective view of an electrical connector as shown in FIG. 1.

Referring to FIGS. 1 and 2, an SFP (Small Form-factor Pluggable) electrical connector 100 includes an insulative housing 10, a row of upper terminals 20, a row of lower terminals 30, and an insulative body or insulator 40. The row of upper terminals 20 are insert molded in the insulative body 40 and constitute a terminal module 50.

Figure 3:
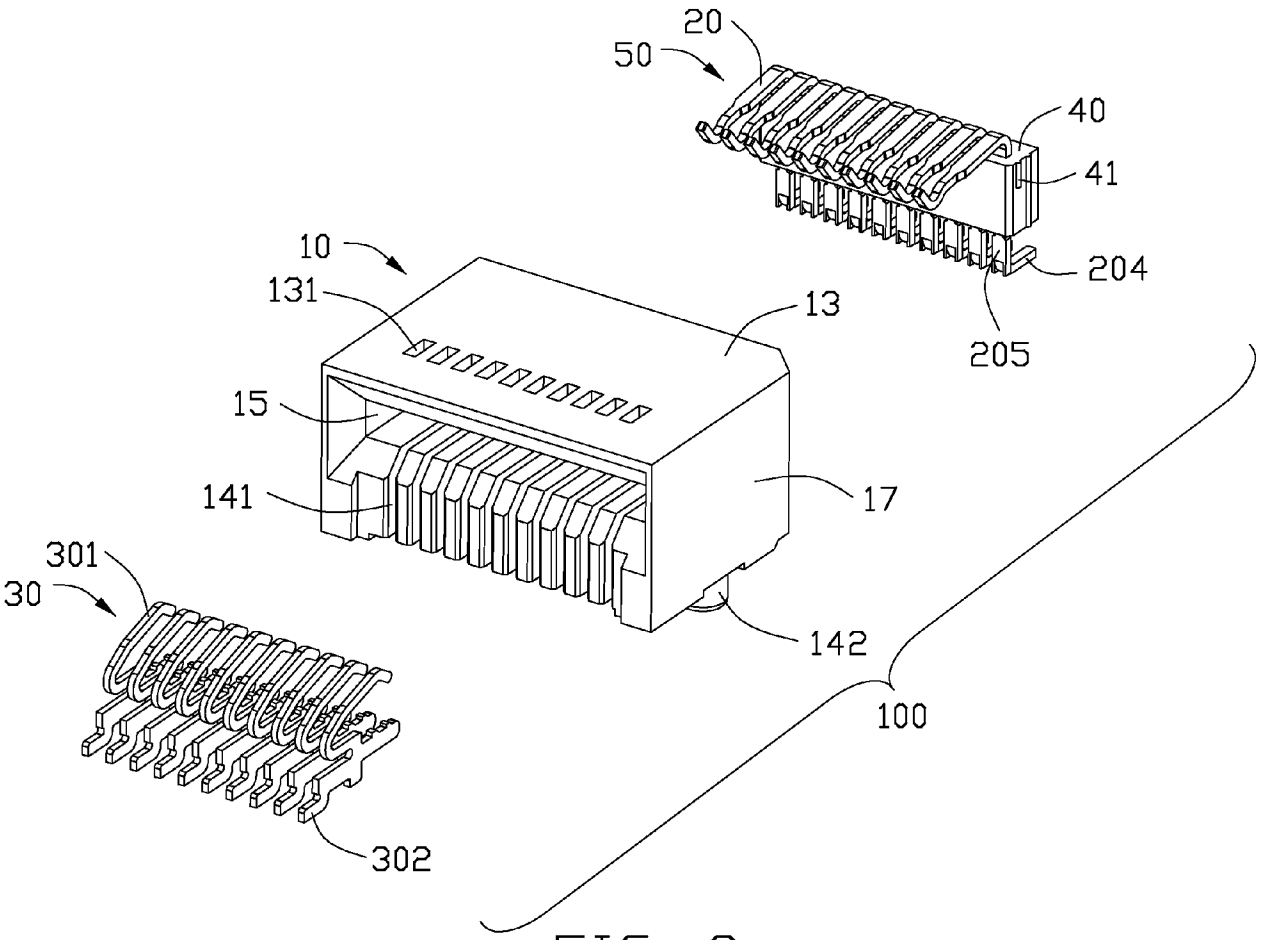
FIG. 3 is an explosive view of the electrical connector according to the present invention.
Figure 4:
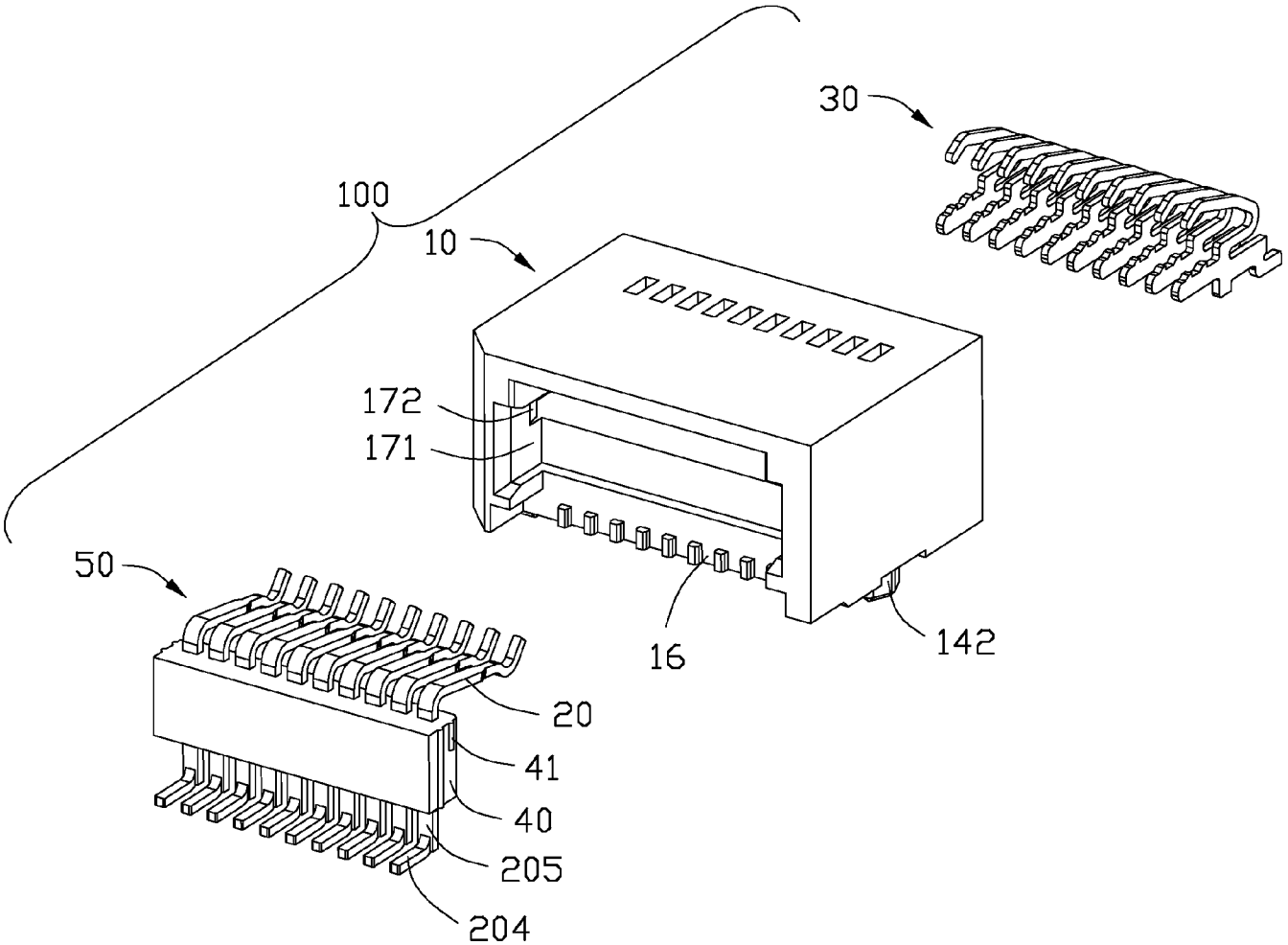
FIG. 4 is another explosive view of the electrical connector as shown in FIG. 3.

Referring to FIGS. 3 and 4, the insulative housing 10 includes a mating face 11, a rear face 12, an upper wall 13, a lower wall 14, and a receiving space 15 between the upper wall 13 and the lower wall 14. Both of the upper wall 13 and the lower wall 14 backwardly extend from the mating face 11. The upper wall 13 defines a number of first terminal slots 131. The lower wall 14 defines a number of second terminal slots 141. The terminal module 50 as a whole is mounted into the first terminal slots 131 from the rear face 12 along a back-to-front direction. The lower terminals 30 are mounted into the second terminal slots 141 from a mating face 11 along a front-to-back direction. The lower terminal 30 has a second elastic arm 301 forwardly extending into the second terminal slots 141 and an engaging section 302 extending beyond the mating face 11.

Figure 5:
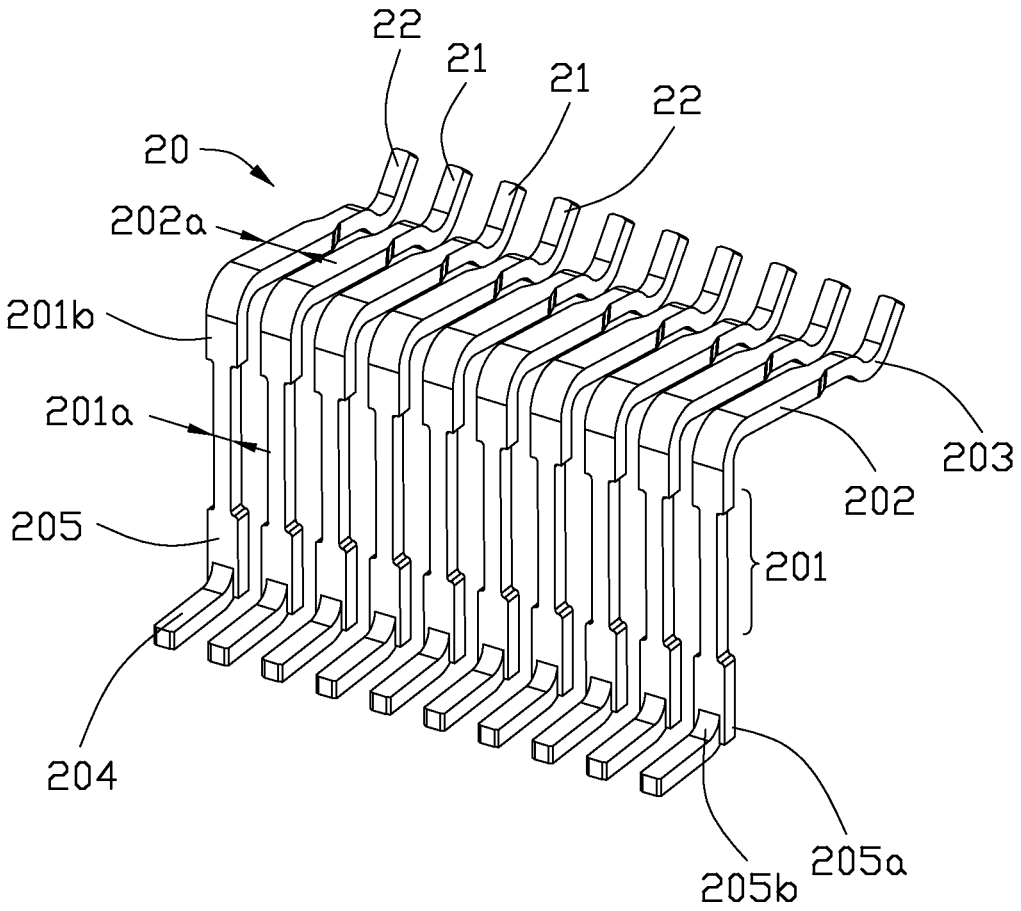
FIG. 5 is a perspective view of the upper terminals of the electrical connector according to the present invention.
Figure 6:
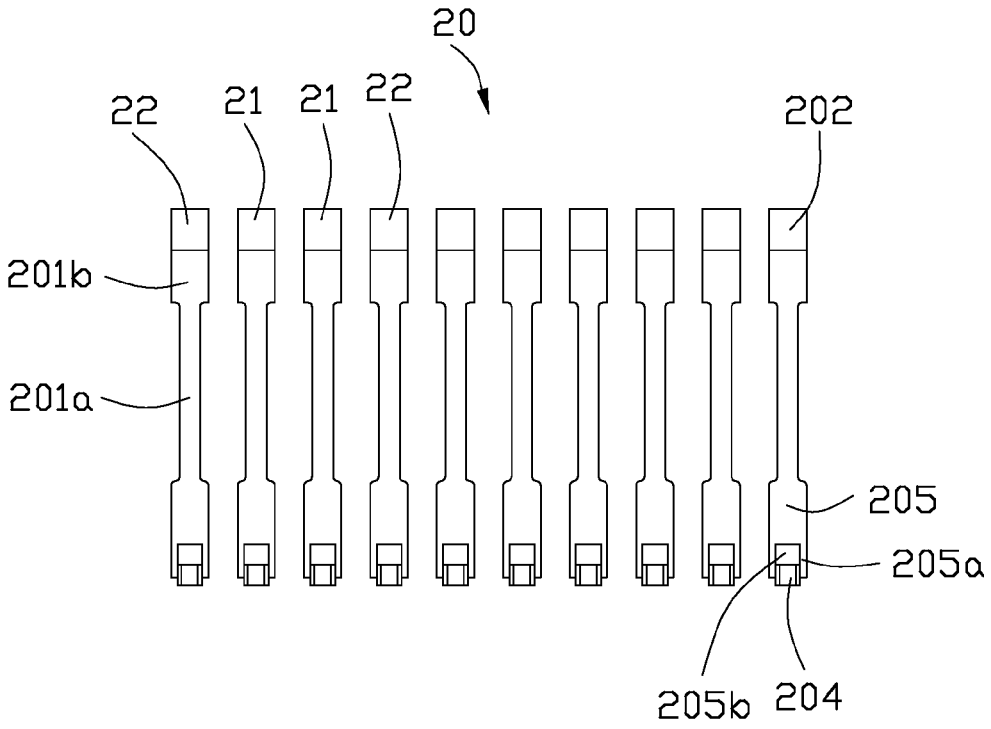
FIG. 6 is a rear view of the upper terminals of the electrical connector according to the present invention.
Figure 7:
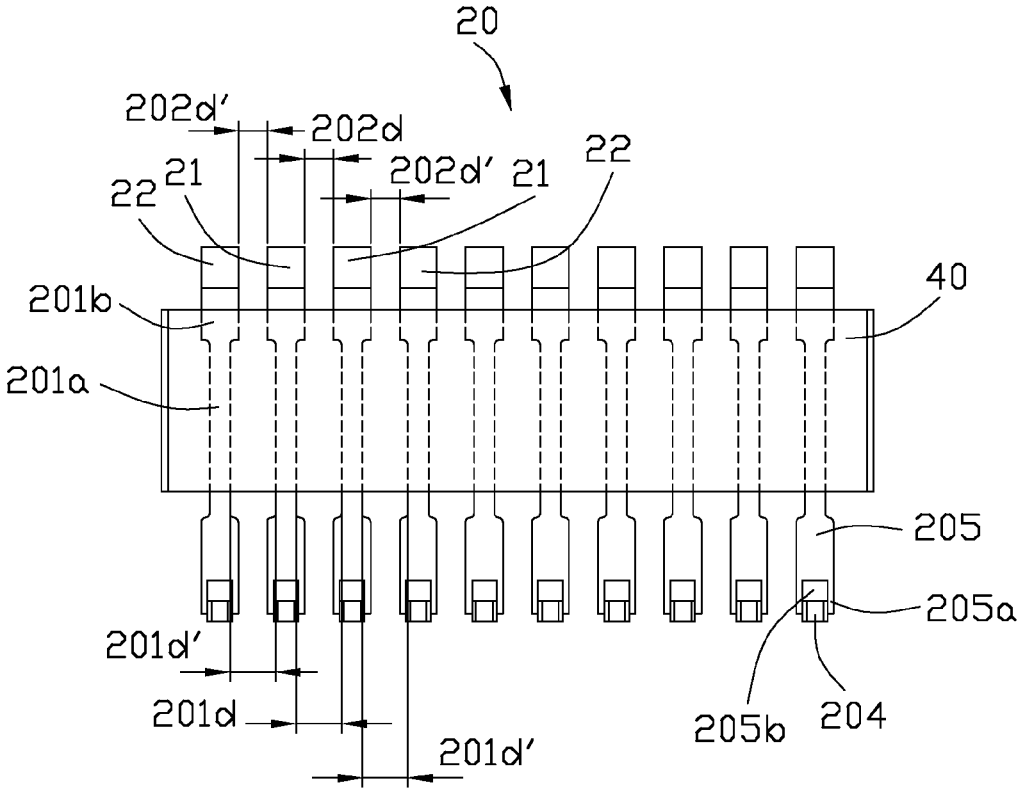
FIG. 7 is a perspective view of the terminal module of the electrical connector according to the present invention.

Referring to FIGS. 5-7, the upper terminal 20 has a fixed portion 201 fixed in the insulative body 40, an elastic arm 202 extending from the fixed portion 201 beyond the insulative body 40, and a contact portion 203 extending from the elastic arm 202. The elastic arm 202 is received in the first terminal slot 131. The contact portion 203 is received in the receiving space 15. The upper terminal 20 includes a pair of signal terminals 21 for differential signal transmission and a respective ground terminal 22 on two sides of the pair of signal terminals 21. The structure of the signal terminal 21 is same as the structure of the ground terminal 22.

Both the fixed portions 201 of the signal terminal 21 and the ground terminal 22 have a same first width 201*a*. Both the elastic arms 202 of the signal terminal 21 and the ground terminal 22 have a same second width 202*a*. The second width 202*a* is wider than the first width 201*a*. Each first distance 201*d* which is between two adjacent fixed portions 201 of the signal terminal 21 is same. Each second distance 201*d*' which is between a fixed portion 201 of a ground terminal 22 and another fixed portion 201 of a signal terminal 21 adjacent to aforesaid ground terminal 22 is same. Each third distance 202*d* which is between two adjacent elastic arms 202 of the signal terminal 21 is same. Each fourth distance 202*d*' which is between an elastic arm 202 of a ground terminal 22 and another elastic arm 202 of a signal terminal 21 adjacent to aforesaid ground terminal 22 is same.

The fixed portion 201 includes a widened portion 201*b* connecting with the elastic arm 202. The width of the widened portion 201*b* is wider than the first width 201*a*. The width of the contact portion 203 is small than the width of the elastic arm 202. The contact portion 203 electrically connects with mating connector entering into the receiving space 15. The fixed portion 201 extends in a vertical direction. The upper terminal 20 further includes a soldering portion 204 and a positioning portion 205 connecting the fixed portion 201 and the soldering portion 204. The soldering portion 204 backwardly extends in a horizontal direction. The positioning portion 205 includes a bending portion 205*a* and two torn edges 205*b*. Each of the torn edges 205*b* is in one side of the bending portion 205*a*. A slit is between the torn edge 205*b* and the bending portion 205*a*.

Referring to FIGS. 3 and 4, the rear face 12 of the insulative housing 10 defined a number of tabs, the middle of adjacent two tabs forming a groove 18. The positioning portion 205 is received in the groove 18. The insulative housing 10 further includes two side walls 17 connecting with the upper wall 13 and the lower wall 14. The side wall 17 defines a guide slot 171. The terminal module 50 is mounted along a back-to-front direction in the guide slot 171. The insulative body 40 is received in the guide slot 171. The side wall 17 has a recess 172 in the guide slot 171, the insulative body 40 having a flange 41. When the insulative body 40 is received in the guide slot 171, the flange 41 is held in the recess 172. The electrical connector 100 further includes a mounting post 142 on the lower wall 14 for mounting on the outer component.

The structure of the upper terminals 20 are so designed that insertion loss of the electrical connector 100 will be reduced. The electrical connector 100 provides less than −1 dB of insertion loss when used as a different signal pair at a signaling frequency of 17 GHz. The electrical connector 100 provides greater than −10 dB of return loss when used as a different signal pair at a signaling frequency of 17 GHz.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing defining a front mating face, an upper wall, a lower wall, and a receiving space between the upper wall and the lower wall, the upper wall defining a plurality of first terminal slots, the lower wall defining a plurality of second terminal slots;

a plurality of upper terminals and a plurality of lower terminals received in the insulative housing, the upper terminals comprising a pair of signal terminals and a ground terminal on one side of the pair of signal terminals; and an insulative body insert molded with the upper terminals to constitute a terminal module, the upper terminal having a fixed portion insert molded in the insulative body and an elastic arm extending beyond the insulative body and received in the first terminal slot;

wherein both the fixed portions of the signal terminal and the ground terminal have a same first width, both the elastic arms of the signal terminal and the ground terminal have a same second width, the second width is wider than the first width, every two adjacent fixed portions of the upper terminals are equidistant, and every two adjacent elastic arms of the upper terminals are equidistant; and wherein the fixed portion extends in a vertical direction, and the upper terminal comprises a soldering portion backwardly extending in a horizontal direction.

2. The electrical connector as claimed in claim 1, wherein the fixed portion comprises a widened portion connecting with the elastic arm, the width of the widened portion being wider than the first width.

3. The electrical connector as claimed in claim 1, wherein the upper terminal comprises a contact portion extending into the receiving space for connecting with a mating connector, the width of the contact portion being smaller than the width of the elastic arm.

4. The electrical connector as claimed in claim 1, wherein the pair of signal terminals provides less than −1 dB of insertion loss when used as a different pair at a signaling frequency of 17 GHz.

5. The electrical connector as claimed in claim 1, wherein the upper terminal comprises a positioning portion between the fixed portion and the soldering portion, the positioning portion comprising a bending portion and a torn edge beside the bending portion.

6. The electrical connector as claimed in claim 5, wherein the insulative housing comprises a rear face having a plurality of tabs, a middle of adjacent two tabs forming a groove, the positioning portion received in the groove.

7. The electrical connector as claimed in claim 1, wherein the insulative housing comprises two side walls connecting with the upper wall and the lower wall, the side wall has a guide slot, and the terminal module is mounted along a back-to-front direction in the guide slot.

8. The electrical connector as claimed in claim 7, wherein the side wall has a recess in the guide slot, and the insulative body has a flange clamped into the recess.

9. An electrical connector comprising:

an insulative housing including opposite upper and lower walls opposite to each other with a receiving space therebetween in a vertical direction;

a plurality of upper terminals disposed in the housing with upper contacting portions exposed around the upper wall;

a plurality of lower terminal disposed in the housing with lower contacting portions exposed around the lower wall;

each of said upper terminals including an elastic arm linked to and located behind the corresponding contacting portion and extending along an interior surface of the upper wall in a front-to-back direction perpendicular to said vertical direction, a fixed portion linked to a rear end of the elastic arm and extending downwardly, and a solder portion located below the fixed portion in the vertical direction; and at least a section of the fixed portion of said upper terminal being integrally formed with and embedded within an insulator so as to have the insulator with all said upper terminals be a terminal module, wherein each of the lower terminals is stamped from sheet metal with a thickness direction parallel to a transverse direction perpendicular to both said front-to-back direction and said vertical direction while each of the upper terminal is stamped from sheet metal with a thickness direction perpendicular to said transverse direction; wherein each of the lower terminals extends in a vertical plane and includes a retention post with retention barbs in said vertical plane; wherein the upper terminals are commonly forwardly assembled into the housing via said terminal module while the lower terminals are respectively rearwardly inserted into corresponding passageways of the housing.

* * * * *